United States Patent [19]

Kenney

[11] Patent Number: 4,771,818

[45] Date of Patent: Sep. 20, 1988

[54] PROCESS OF SHAPING A METAL ALLOY PRODUCT

[75] Inventor: Malachi P. Kenney, Chesterfield, Mo.

[73] Assignee: Alumax Inc., San Mateo, Calif.

[21] Appl. No.: 290,217

[22] Filed: Aug. 5, 1981

Related U.S. Application Data

[63] Continuation-in-part of Ser. No. 103,607, Dec. 14, 1979, abandoned, which is a continuation of Ser. No. 927,826, Jul. 25, 1978, abandoned.

[51] Int. Cl.[4] ..... B22D 17/00; B22D 23/00

[52] U.S. Cl. ..... 164/71.1; 164/80; 164/113; 164/900

[58] Field of Search ..... 164/120, 113, 900, 71.1, 164/80

[56] References Cited

U.S. PATENT DOCUMENTS

| | | | |
|---|---|---|---|
| 3,902,544 | 9/1975 | Flemings et al. | 164/900 X |
| 3,948,650 | 4/1976 | Flemings et al. | 75/135 |
| 4,011,901 | 3/1977 | Flemings et al. | 164/900 X |
| 4,108,643 | 8/1978 | Flemings et al. | 75/135 |
| 4,345,637 | 8/1982 | Flemings et al. | 164/113 |

OTHER PUBLICATIONS

Kulkarni, K. M., *Squeeze Casting Comes of Age,* in Foundry Management & Technology, Aug. 1974, pp. 76–79, 164–120.

*Metals Handbook,* 8th Ed., vol. 5, 1970, pp. 128, 129, 131, TA 472, A3.

Flemings, M. C. et al., *Rheocasting Processes,* in AFS International Cast Metals Journal, Sep. 1976, pp. 11–22.

Young, K. P. et al., "Structure and Properties of Thixocast Steels," in *Metals Technology,* Apr. 1979, pp. 130–137.

Flemings, M. C. et al., "Thixocasting of Steel" Paper No. G-T77-092, Society of Die Casting Engineers, 9th International Congress, Jun. 6–9, 1977.

*Primary Examiner*—Nicholas P. Godici
*Assistant Examiner*—J. Reedbatten, Jr.
*Attorney, Agent, or Firm*—Malcolm B. Wittenberg

[57] ABSTRACT

A process for shaping a metal alloy in which a semi-solid metal alloy charge is shaped under pressure in a closed die cavity. The metal alloy is vigorously agitated, while in the form of a liquid-solid mixture, to convert from 30% to 55% by volume to discrete degenerate dendritic solid particles. The liquid-solid mixture is then cooled to solidify the mixture and reheated to form a semi-solid slurry. The reheated metal alloy slurry contains discrete degenerate dendritic primary solid particles, in a concentration from about 70 to 90% by volume based upon the volume of the alloy, suspended homogeneously in a secondary liquid phase. The process is characterized by low pressure and very rapid shaping and solidification times. The process produces complex, close tolerance, high quality metal alloy parts.

15 Claims, 2 Drawing Sheets

PROCESS OF SHAPING A METAL ALLOY PRODUCT

Figure 1:
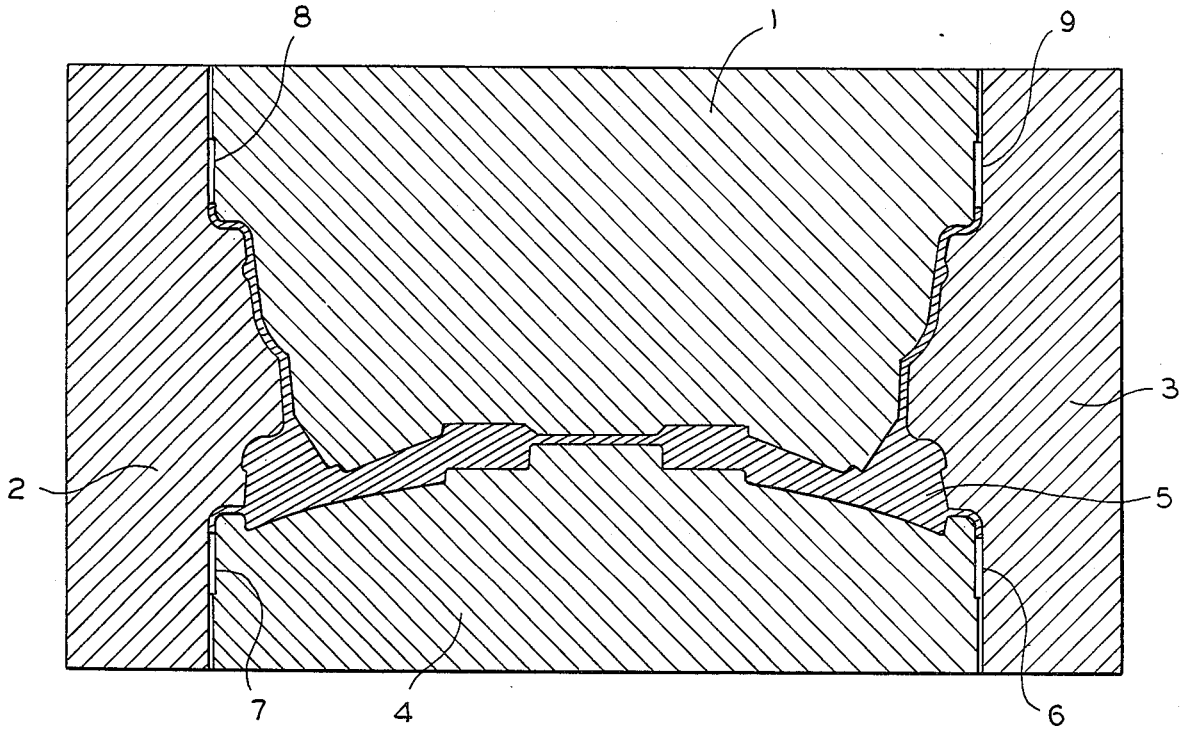

This application is a continuation-in-part of my copending application Ser. No. 103,607, filed Dec. 14, 1979, now abandoned, which in turn is a continuation of copending application Ser. No. 927,866, filed July 25, 1978, now abandoned.

This invention relates to a process of forming a shaped metal alloy product and more particularly to a process for producing complex, close tolerance metal alloy parts by press forging.

Shaped metal alloy parts are produced from wrought alloys by forging techniques to obtain optimum physical properties. Where the part has a relatively complex shape, it must normally be formed by utilizing casting alloys, usually at the sacrifice of physical properties. It would be desirable to utilize alloys providing the characteristics of wrought products in a forming process capable of producing complex shapes.

There has recently been developed certain alloys having a microstructure such that they may be cast from a liquid-solid mixture rather than a liquid and thus solidifed from a lower temperature than conventional casting alloys. Such alloys and their preparation are disclosed, for example, in U.S. Pat. No. 3,948,650 which issued an Apr. 6, 1976, U.S. Pat. No. 3,954,455 which issued on May 4, 1976 and U.S. Pat. No. 4,108,643 which issued on Aug. 22, 1978. As there disclosed, the partially solidified metal alloys, in the form of slurries, can be shaped into alloy parts by a variety of metal forming processes, including die casting, permanent mold casting, closed die forging, hot pressing and other known techniques.

A primary object of the present invention is to provide a process for producing metal alloy parts having the complex shapes normally characteristic of cast alloys with properties approximating those of parts produced from wrought alloys.

An additional object of this invention is to produce complex, close tolerance metal alloy parts by a low pressure press forging process having the economics of casting techniques.

It is still an additional object of this invention to provide a process for producing such metal alloy parts at high production rates.

The foregoing and other objects of the invention are achieved in a process in which a metal alloy composition is heated to form a liquid-solid mixture, the liquid-solid mixture is vigorously agitated to convert the solid therein to discrete degenerate dendritic primary solid particles suspended homogeneously in a secondary liquid phase having a lower melting point than said primary solid particles, and the liquid-solid mixture is then shaped in a closed die cavity. The process comprises vigorously agitating said liquid-solid mixture to convert from 30% to 55% by volume thereof to said discrete degenerate dendritic primary solid particles, cooling said liquid-solid mixture prior to shaping to solidify said mixture and form a solid metal alloy charge containing no more than 55% by volume discrete degenerate dendritic primary solid particles in a solid secondary phase, reheating said metal alloy charge to convert the charge to a semi-solid slurry containing said discrete degenerate dendritic primary solid particles suspended in said secondary liquid phase, the proportion of said solid particles being increased by said reheating to from 70 to 90% by volume, based upon the volume of said alloy, shaping said 70 to 90% by volume semi-solid slurry under pressure in said closed die cavity in a time of less than about one second, said die cavity having been preheated to a temperature of from about 100 to 450° C., and solidifying the shaped alloy in said die cavity at a pressure of at least about 500 psig in a time of less than one minute.

Figure 2:
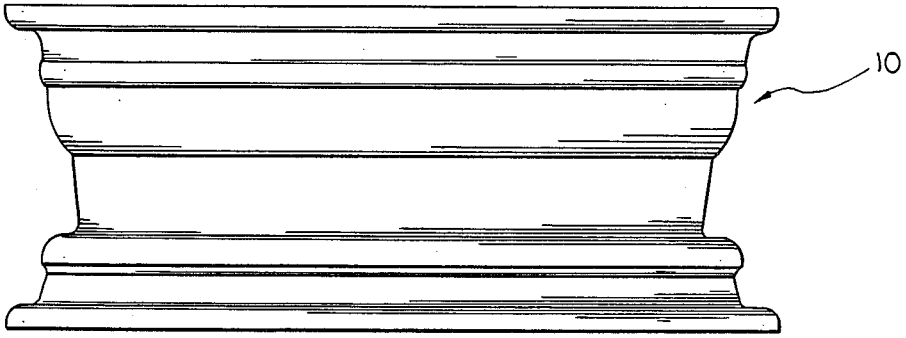
Figure 3:
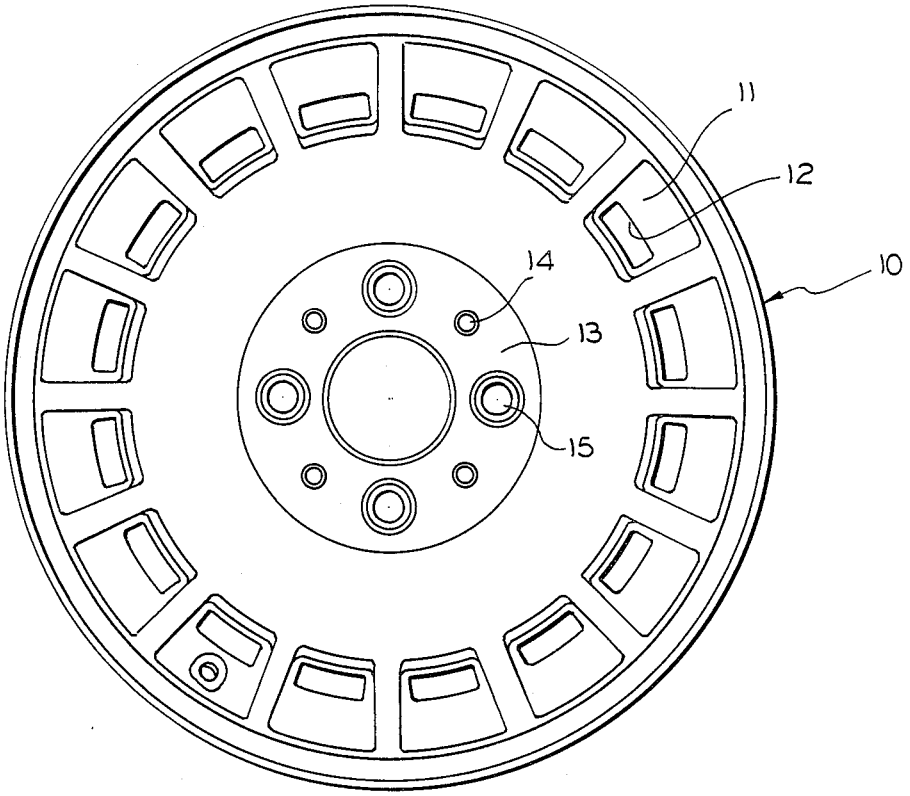

The invention will be better understood from the following description taken in connection with the accompanying drawing in which FIG. 1 is a vertical crosssectional view of dies in closed position in a press suitable for use in the invention;

FIG. 2 is an elevational view of an automobile wheel produced in the press of FIG. 1; and FIG. 3 is a plan view of the wheel shown in FIG. 2.

The metal charge or preform used in the process of the invention is semi-solid—a part liquid and part solid mixture. The solid particles are rounded in shape and are normally between about 20 and 200 microns in diameter. The metal composition is characterized by discrete degenerate dendritic primary solid particles suspended homogeneously in a secondary phase having a lower melting point than the primary particles. Both the primary and secondary phases are derived from the metal alloy.

Apart from the shaping steps, there are several features of the present process which distinguish it from the process disclosed in the aforementioned U.S. Pat. Nos. U.S. Pat. Nos. 3,948,650 and 3,954,455 disclose the vigorous agitation of a liquid-solid alloy mixture containing up to 65 weight % of solids. In U.S. Pat. No. 4,108,643, the solids percentage is from 65 to 85%. In the present invention, the vigorously agitated liquid-solid alloy mixture contains no more than 55%, and typically no more than 40%, by volume of solids. Such a solids fraction upper limit is essential to maintain an acceptable flow rate for the first portion of the process, i.e., through solidification of the vigorously agitated liquid-solid mixture to form a solid metal alloy charge.

The aforesaid patents further disclose that after vigorous agitation to form the discrete degenerate dendritic structure, the liquid-solid mixture may be formed into its intended shape with or without prior solidification. It has been found however that, in order to shape the liquid-solid mixture at high fraction solids (70 to 90% solids) in accordance with the present invention, the liquid-solid mixture must be solidified, reheated and then shaped. The double processing, or temperature cycling, of the liquid-solid mixture gives rise to significant metallurgical changes in the alloys. The two cycles through the semi-solid range cause substantial "rounding off" of the solid fraction particles making them much smoother and rounder than they were at the time of first forming. The proportion of discrete degenerate dendritic particles is increased from an original maximum of 55% to from 70–90% by volume. In addition, the range of particles diameters narrows such that the material is more homogeneous. These smooth particles, therefore, allow much more extensive fluid flow than would be expected. The exceptionally high fluidity in the alloys is such that the shear rates for fraction solids in the 70 to 90% range are in the same general regime of shear rates that would be used for alloys of fraction solids 60% or less. The viscosity at rest (or the viscosity at limiting shear) of the reheated semi-solid metal alloy slurry will normally be above 200 poise and usually above 1000 poise. Shear rate, computed from ram velocity, will normally be above 500 $sec^{-1}$.

The fluidity of these alloys is unexpectedly high on a number of counts. In the first instance, it is to be noted that the alloy used for forming at 70–90% solids is initially produced by allowing to freeze, without vigorous agitation and normally in a quiescent non-agitated fashion, a mixture containing not more than 55% by volume and typically only 40% fraction discrete degenerate solids formed in the manner taught by the aforementioned patents. Thus, at least 21% (15/70) and up to as much as 39% (35/90) of the solid fraction of the alloy at the time of final forming to shape has not been subjected to the vigorous stirring necessary for discrete degenerate dendrite formation. This fraction of the alloy will have frozen in the absence of agitation and is presumably dendritic. Thus, the alloy has sufficient fluidity to be formed at very high solids content even though a significant portion of the solids fraction may not have been agitated.

Second, and apart from the above, the published literature on semi-solid alloy slurries, of the type to which the present invention is directed, indicate apparent viscosities of the order of 10 poise for about a 60% solids slurry (lower than the fraction solids here used in the shaping steps) at relatively high shear rates of about 1000 $sec^{-1}$. This is 1000 times greater than the typical viscosities of liquid casting alloys which are of the order of 0.01 poise (or one centipoise). Moreover, the literature on semisolid alloys also indicates that the viscosity of these semi-solid alloys is both shear rate and cooling rate dependent and that the apparent viscosity responds to changes in shear rate only slowly—of the order of many seconds. The literature references to viscosities of 10 poise for 60% semi-solid alloy slurries refer to viscosities measured at relatively high shear rates (1000 $sec^{-1}$) and cooling rates which are long relative to typical production conditions. This published data further predicts apparent viscosities to rise almost vertically at fraction solids above 60% indicating essentially solid-like behavior at higher fraction solids even at 1000 $sec^{-1}$ shear rate and even allowing sufficient time for the alloys to achieve their minimum characteristic viscosity for the shear rate.

It has been found, however, that alloys containing fraction solids even greater than that of the foregoing literature, i.e., fraction solids between 70–90%, and exhibiting apparent viscosities in the ready-to-form state of 10,000, even 100,000 or 1,000,000 poise, can be formed at low pressures into complex shapes, using shear rates below that predicted necessary to achieve reasonable fluidity in alloys containing much less fraction solids (50–60%). In addition, it has been found that forming times must be short which precludes attainment of the characteristic viscosity (and therefore must result in apparent viscosities lying closer to the starting viscosity) during the forming stroke. Thus, alloys of extremely high apparent viscosity formed from an alloy produced as a mixture of discrete degenerate and dendritic portions can be formed into complex shapes under extremely low pressures, in short times and using relatively low shear rates even though available data would suggest solid-like behavior at relatively low fractions solids and high shear rates.

The generally rounded nature of the discrete degnerate dendritic particles and the exceptionally high fluidity of the alloys permit the solid particles to flow in a viscous fashion in a continuous liquid matrix. This permits the relatively low pressure forming of the part. The pressure used in the process will normally range from about 500 to 5000 psig which permits the forming of parts as large as a full sized (14") automobile wheel to be formed in a 250 ton press as compared to a 1200 ton die casting machine or an 8000 ton press used for conventional forging.

The largely solid nature of the charge, which ranges from 70 to 90% by volume solids, permits very rapid solidification with a minimum of liquid/solid shrinkage. This, in turn, permits forming parts without large "feeding reservoirs" or risers and allows very short residence in the dies. The latter point is vital to the high production rates attainable with this process, e.g. a realistic rate of 240 automobile wheels an hour or 500 small parts an hour may readily be sustained.

The rapid solidification means that nearly all sections of the part, of equal section thickness, will solidify at the same time and thus may be ejected very rapidly, and usually in less than 4 seconds after forming for high conductivity alloys such as aluminum and copper. For ferrous alloys or for parts of relatively large crossection, solidification time may extend to 15 to 20 seconds, but in any event, will always be less than a minute and usually substantially less. The rapid ejection releases the part from many of the constraints of the solid state contraction which normally occurs with decreasing temperature. Such contraction can progress to the point at which binding on the dies causes high stresses and resulting hot tears or cracks in the shaped part.

Products produced in accordance with the invention possess many of the properties of a forging, but may contain the complex shapes and shape tolerances typical of a casting. The products may be produced using nominally wrought composition alloys having the levels of tensile strength, fatigue strength, ductility and corrosion resistance comparable to forged or wrought products produced from these alloys. Moreover, the process is capable of producing relatively large parts. Automobile wheels, for example have been prepared having many of the characteristics of forged wheels, utilizing considerably simplified pressing equipment in a considerably more efficient manner than conventionally forged wheels.

In the process of the invention, a preform is heated until 10–30% of its volume becomes liquid. The temperature to which the preform is heated is between the liquidus and solidus temperature for the particular alloy and will vary from heat to heat within a given alloy system depending on the particular chemistry. Since there is no specific temperature at which the metal will form properly, the viscosity as measured by the resistance to penetration of a probe into the semi-solid, may be used as an indicator of the % liquid present in the mixture. Generally the range of 5 psig to 15 psig will be used, the exact pressure being selected to suit the conditions of the part to be formed.

Low pressures may be used to shape the preheated billet providing no significant additional solidification occurs during the shaping step. Thus, in order to insure the use of low pressures, a shaping time in the die cavity of less than one second is required, as for example, from 0.1 to 0.5 seconds. The die cavity is preheated to a temperature of from 100 to 450° C. for example, from 200° to 300° C., depending primarily upon part configuration, in order to prevent significant solidification during the forming or shaping step. If temperatures are too high, there is a tendency for adhesion of the preform to the die, known as die soldering, to occur. During the forming stroke, the pressure rises from zero to the pressure used for solidification. By the end of the forming stroke, the pressure has accordingly risen to about 500 to 5000 psig, usually 500 to 2500 psig, and solidification of the liquid phase begins. Thus the pressure gradually rises during the shaping stroke and remains at a peak of from 500 to 5000 psig during solidification. The applied pressure enhances heat transfer from the metal alloy to the die and feeds solidification shrinkage. If the pressure is too low, porosity may be at an unacceptable level or complex molds may fill incompletely. Pressures above 5000 psig may be used for small parts but they are not necessary for large parts. Moreover, higher pressures may create a venting problem. It is desirable to form the part at as low a pressure as possible for reasons of process economy, simplicity of pressing equipment and for die life. Residence time in the die cavity, subsequent to the shaping step, should be short enough, under one minute and preferably less than 4 seconds, to avoid hot cracking of the shaped part from thermal contraction stresses but long enough to complete solidification of the liquid phase of the alloy. Specific times will depend on part thickness. The tendency for hot cracking to occur is a function of alloy composition, fraction solids percent, die temperature and part configuration. Within the ranges of forming and solidification times herein set forth, times should, of course, be kept as short as possible to maximize part-making productivity. As is apparent from the foregoing discussion, times, pressures, temperatures and alloy solid fraction are a combination of critical variables which together function to achieve the significant process economies and product improvements herein set forth.

The shaping process of the invention may be carried out, for example in a 150–250 ton hydraulic press equipped with dies or molds of the type illustrated in FIG. 1 of the drawing. The specific die set there shown is contoured to produce a relatively large complex shape, in this case a highly styled automobile wheel. The die set comprises a movable top die or ram 1, two side dies 2 and 3 and bottom die 4. The dies are shown in closed position, the alloy metal 5 having been shaped into the contour of an automobile wheel.

Another feature of the invention involves the manner in which the dies are vented. The length and diameter of venting channels must be of adequate size to provide ample venting. On the other hand, an the channels must normally be sufficiently narrow and long to avoid spraying the molten metal to the exterior of the dies. Venting channels of conventional size, of a diameter used for example in die casting, have proven too narrow to eliminate air pockets in the present press forming process. It has been found, however, that the high solids fraction present during the pressing cycle of the present invention permits wider and shorter venting channels to be used. The result is not only the absence of air pockets in the shaped product, but fewer limitations on die design, the latter because less area is needed to achieve adequate venting. Four such vents, 6, 7, 8 and 9, are shown in crosssection in FIG. 1. It will be seen from FIG. 1 that the shaping operation actually involves a concurrent forward extrusion of semi-solid metal into the narrow channels opening into vents 6 and 7, a backward extrusion of semisolid metal into the channels leading to vents 8 and 9 and a forging stroke against the central portion of the metal in the press. Reference herein to "complex" shapes is intended to identify parts which require such concurrent forward and backward extrusion combined with a forged step in the process herein set forth.

The following examples are illustrative of the practice of the invention. Unless otherwise indicated, all parts are by weight.

EXAMPLE 1

An 18 pound billet of 6061 wrought aluminum alloy was cast, from a semi-solid slurry containing approximately 50% by volume degenerate dendrites produced substantially as set forth in U.S. Pat. No. 3,948,650. The billet, approximately six inches in diameter, had the following composition:

| Si | Cr | Mn | Fe | Mg | Ti | Cu | B | Al |
|---|---|---|---|---|---|---|---|---|
| 0.63 | 0.06 | 0.06 | 0.22 | 0.90 | 0.012 | 0.24 | 0.002 | Balance |

The billet, contained in a stainless steel canister, was placed within a resistance furnace set at a temperature 677° C. This temperature, approximately 28° C. above the liquidus temperature of the alloy, was sufficient to induce partial melting of the alloy without creating significant variations in fraction liquid within the billet. At a temperature at 632° C., corresponding to a fraction solid of approximately 0.80, as detected by the penetration of a weighted probe, the billet in its canister was transferred to the closed bottom half of a cast iron die set, of the type shown in FIG. 1, maintained at 315° C. and ejected from the canister to the bottom of the die. The die set was coated with a graphite base lubricant. The top die, also maintained with a surface temperature of approximately 315° C., was then closed at a speed of 20 inches per second, resulting in a preform shaping time of about 0.2 seconds, the die reaching a maximum pressure of 2100 psig such that the cavity so formed was filled with alloy. After a holding time under pressure of 2.4 seconds, during which the liquid phase of the part solidified, the die set was opened and the shaped part extracted.

The shaped part, an aluminum wheel, was sectioned and specimens for mechanical property measurement were taken. Room temperature properties were measured. Ultimate tensile strength was 47,000 psi, yield strength was 43,000 psi and elongation in a 1" gauge length was 7%. Minimum specifications for closed die forgings of 6061 aluminum alloys as set forth in Aluminum Standards and Data 1976, Fifth Edition 1976 are 38,000 psi ultimate tensile strength, 35,000 psi yield strength and 7% elongation. Representative minimum specifications of an automobile manufacturer for cast aluminum wheels are 31,000 ultimate tensile strength, 16,500 yield strength and 7% elongation.

EXAMPLE 2

A semi-solid slurry of A356 aluminum casting alloy was vigorously agitated essentially as set forth in U.S. Pat. No. 3,948,650 containing 40% by volume discrete degenerate dendritic solid particles. The semi-solid slurry was rapidly cooled without agitation to form an 18 pound solid metal alloy billet containing 40% by volume discrete degenerate dendritic primary solid particles in a solid secondary phase. The billet, approximately six inches in diameter, had the following composition:

| Si | Mn | Fe | Mg | Ti | Cu | Al |
|---|---|---|---|---|---|---|
| 7.0 | 0.004 | 0.090 | 0.3 | 0.13 | 0.10 | Balance |

The billet, contained in a stainless steel canister, was placed within a resistance furnace set at a temperature of 660° C. This temperature, approximately 47° C. above the liquidus temperature of the alloy, was sufficient to induce partial melting of the alloy without creating significant variations in fraction liquid within the billet. At a temperature of 580° C. corresponding to a fraction solid of approximately 0.75 as detected by the penetration of a weighted probe, the billet in its canister was transferred to the closed bottom half of a cast iron die set, of the type shown in FIG. 1, maintained at 293° C. and ejected from the canister to the bottom of the die. The die set was coated with a graphite base lubricant. The top die, also maintained with a surface temperature of approximately 260° C., was then closed at a speed of 16 inches per second, resulting in a preform shaping time of about 0.2 seconds, the die reaching a maximum pressure of 2100 psig such that the cavity so formed was filled with alloy. After a holding time under pressure of 4.0 seconds, during which the liquid phase of the part solidified, the die set was opened and the shaped part extracted.

The shaped part, an aluminum wheel, was sectioned and specimens for mechanical property measurement were taken. Room temperature properties were measured. Ultimate tensile strength was 41,000 psi, yield strength was 35,000 psi and elongation in a 1" gauge length was 6%.

Unlike wrought products whose properties are directional, the products of the invention are isotropic—their properties are equal in all directions. The metallurgical structure of the wheel of the example consisted of randomly oriented, equiaxed grain structure without the "texture" associated with wrought components having similar properties.

A finished wheel generally identified by the numeral 10 produced in accordance with the invention is shown in elevation in FIGS. 2 and 3. The plan view of FIG. 3 shows the wheel as viewed from the direction of the bottom die in FIG. 1. The wheel contains a plurality of roughly rectangular contours 11 around the periphery, each of the contours containing a punched or machined hole 12 therethrough. A hub area 13 contains four cored and tapped holes 14 and four larger punched or machined holes 15. A wheel configuration of this complexity is normally produced by permanent mold or die casting techniques and is accordingly limited in its properties to the relatively inferior properties associated with such processes. Material properties are thus a limiting factor on wheel weight. Lower properties must be compensated by greater bulk in a cast wheel. Moreover, larger crossections are normally necessary in casting because of limitations inherent in casting techniques—it is difficult to fill a permanent mold with thin sections. Thus, the wheels of the invention have the very important capability of being lighter in weight than comparable wheels of the prior art.

Representative alloys useful in the press forging process are, in addition to aluminum alloys, ferrous alloys such as the stainless steels, tool steels, low alloy steels and irons and copper alloys of the type normally used in castings and forgings.

It will be recognized that, within the scope of the process parameters set forth herein, many variations may be made in order to accommodate the geometry or the specific property objectives of the component being formed. Changes in alloy chemistry, temperature, speed and pressure of the press and duration of dwell may influence grain structure, avoid shrinkage defects and provide properties to specific portions of the component. Moreover, the process may be used for producing a variety of shaped metal parts other than wheels including, for example, hand tools, valve and pump bodies and parts, propellers and impellers, automotive and appliance parts and electrical and marine components. It is intended in the claims which follow to cover all variations which fall within the scope of the invention.

I claim:

1. In a process for producing a shaped metal alloy part in which a metal alloy composition is heated to form a liquid-solid mixture, the liquid-solid mixture is vigorously agitated to convert the solid therein to discrete degenerate dendritic primary solid particles suspended homogeneously in a secondary liquid phase having a lower melting point than said primary solid particles, and the liquid-solid mixture is then shaped in a closed die cavity, the improvement comprising vigorously agitating said liquid-solid mixture to convert from 30% to 55% by volume thereof to said discrete degenerate dendritic primary solid particles, cooling said liquid-solid mixture prior to shaping to solidify said mixture and form a solid metal alloy charge containing no more than 55% by volume discrete degenerate dendritic primary solid particles in a solid secondary phase, reheating said metal alloy charge to convert the charge to a semi-solid slurry containing said discrete degenerate dendritic primary solid particles suspended in said secondary liquid phase, the proportion of said solid particles being increased by said reheating to from 75 to 90% by volume, based upon the volume of said alloy, shaping said 75 to 90% by volume semi-solid slurry under pressure in said closed die cavity in time of less than about one second, said die cavity having been preheated to a temperature of from about 100° to 450° C., and solidifying the shaped alloy in said die cavity at a pressure of at least about 500 psig in a time of less than one minute.

2. The process of claim 1 in which said metal alloy is solidified at a pressure of from 500 to 2500 psig.

3. The process of claim 1 in which the die cavity has been preheated to a temperature of from 200° to 300° C.

4. The process of claim 1 in which the metal alloy is shaped under pressure in the die cavity in a time of from 0.1 to 0.5 seconds.

5. The process of claim 1 in which the solidification of the liquid phase of the shaped alloy under pressure in the die cavity occurs in a time of less than 4 seconds.

6. The process of claim 1 in which the alloy is an aluminum alloy.

7. The process of claim 1 in which the alloy is a copper alloy.

8. The process of claim 1 in which the alloy is a ferrous alloy.

9. The process of claim 1 in which said shaping process produces to close tolerances a metal alloy of complex configuration.

10. The process of claim 1 in which said die cavity is vented to the atmosphere through a plurality of spaced channels extending from the die cavity to the atmosphere, said channels being of a size sufficient to exhaust any air entrapped in the die cavity during the pressing stage.

11. The process of claim 1 in which the liquid-solid mixture is cooled without agitation prior to shaping.

12. The process of claim 1 in which said reheated semi-solid slurry has a viscosity at rest of at least 200 poise.

13. The process of claim 12 in which said reheated semi-solid slurry has a viscosity at rest of at least 1000 poise.

14. The process of claim 1 in which said metal alloy is solidified at a pressure of no more than about 5000 psig.

15. The process of claim 1 in which the reheating increases the proportion of solid particles to from 80 to 90% by volume and shaping is of the resulting 80 to 90% by volume semi-solid slurry.

* * * * *